US005419472A

United States Patent [19]

Hellweg et al.

[11] Patent Number: 5,419,472

[45] Date of Patent: May 30, 1995

[54] HOLSTER FOR GUNS OR THE LIKE

[75] Inventors: Albert W. Hellweg, Vermont, Australia; Kerby C. Smith, Coarsegold, Calif.

[73] Assignee: Hellweg International Pty. Ltd., Bayswater, Australia

[21] Appl. No.: 188,082

[22] Filed: Jan. 28, 1994

[30] Foreign Application Priority Data

Feb. 11, 1993 [AU] Australia ..... PL7230

[51] Int. Cl.[6] ..... F41C 33/02

[52] U.S. Cl. ..... 224/198; 224/193; 224/911; 224/912

[58] Field of Search ..... 224/911, 912, 192, 193, 224/194, 195, 197, 198, 252, 253, 269, 270, 271, 234, 199, 200, 226, 232, 247, 251, 904, 914

[56] References Cited

U.S. PATENT DOCUMENTS

| | | | |
|---|---|---|---|
| 921,900 | 5/1909 | Shuster | 224/247 |
| 1,214,161 | 1/1917 | Hettinger et al. | 224/247 |
| 2,832,519 | 4/1958 | Ojala | 224/911 |
| 2,917,213 | 12/1959 | Bucheimer et al. | 224/911 |
| 3,261,519 | 7/1966 | Horne | 224/198 |
| 3,915,361 | 10/1975 | Perkins | 224/911 |
| 3,923,214 | 12/1975 | Kippen | 224/911 |
| 4,419,794 | 12/1983 | Horton, Jr. et al. | 224/197 |
| 4,504,001 | 3/1985 | Nichols | 224/911 |
| 4,718,586 | 1/1988 | Hagino | 224/197 |
| 4,874,118 | 10/1989 | Parlante | 224/198 |
| 5,167,355 | 12/1992 | Hill | 224/911 |
| 5,193,725 | 3/1993 | Radocy | 224/200 |
| 5,265,781 | 11/1993 | Nichols | 224/911 |
| 5,269,448 | 12/1993 | Shoemaker | 224/911 |

FOREIGN PATENT DOCUMENTS

| | | | |
|---|---|---|---|
| 3027550 | 3/1982 | Germany | 224/904 |

*Primary Examiner*—Henry J. Recla
*Assistant Examiner*—Gregory M. Vidovich
*Attorney, Agent, or Firm*—Calfee, Halter & Griswold

[57] ABSTRACT

A holster for a gun comprising a pouch for receiving the gun, the pouch being mounted on a belt-receiving member; the belt-receiving member having an elongate slot therein, the pouch being mounted to the belt-receiving member by a fastener passing through the elongate slot, the fastening being able to be selectively released to allow the pouch to be moved axially relative to the belt-receiving member by moving the fastening along the slot, and the pouch being able to be rotated about the fastening.

5 Claims, 2 Drawing Sheets

HOLSTER FOR GUNS OR THE LIKE

TECHNICAL FIELD

This invention relates to a holster for guns or the like and refers particularly, though not exclusively, to a holster for guns or the like wherein the holster is adjustable and rotatable.

BACKGROUND OF THE INVENTION

Throughout this specification reference to "guns" is to include reference to other related products. Although a holster for guns is described, it will be realized that the present invention could be used in relation to many other products which are used in related fields such as, for example, holsters or containers for batons, hand cuffs, ammunition rounds, and the like.

For many years, the manufacturers of holsters have provided holsters which are able to be mounted on a belt or the straps for a shoulder holster. Inevitably, they have been secured to that mounting. Not every user of the holster likes the holster at the same angle or height. Some of this is due to the variation in the butt of the gun, the physique of the wearer, and so forth. If a variation was required, a special model had to be made, or an extra model added to the range by the manufacturer.

It is therefore the principal object of the present invention to provide a holster for guns (as hereinbefore defined) which is adjustable in both height and angle.

SUMMARY OF THE INVENTION

With the above and other objects in mind, the present invention (as hereinbefore defined) comprising a pouch for receiving said gun, said pouch being mounted on a belt-receiving member; said belt-receiving member having an elongate slot therein, said pouch being mounted to said belt-receiving member by means of a fastening means passing through said elongate slot, said fastening means being able to be selectively released to allow said pouch to be moved axially relative to said belt-receiving member by moving said fastening means along said slot, and said pouch being able to be rotated about said fastening means.

BRIEF DESCRIPTION OF THE DRAWING

In order that the invention may be fully understood, there shall now be described by way of non-limitative example only a preferred construction of a holster for guns (as hereinbefore defined) incorporating the principal features of the present invention, the description being with reference to the accompanying illustrative drawings in which:

BRIEF DESCRIPTION OF THE DRAWINGS

Figure 1:
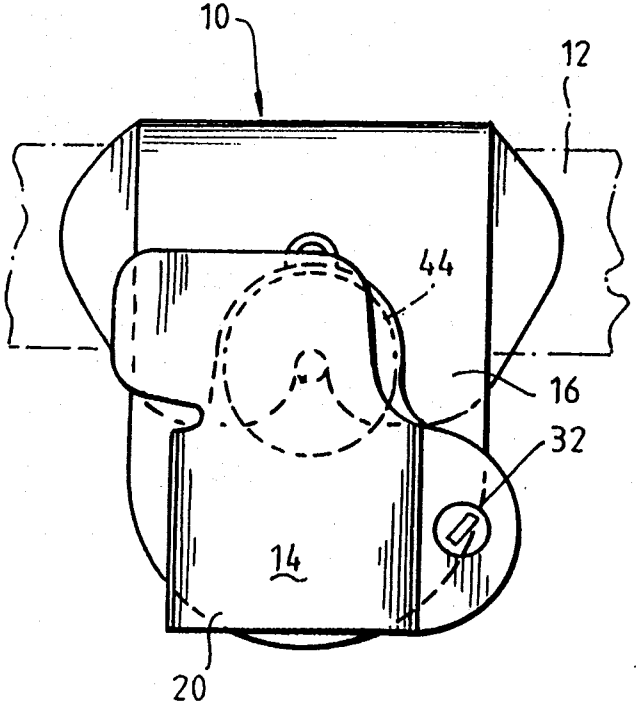
Figure 2:
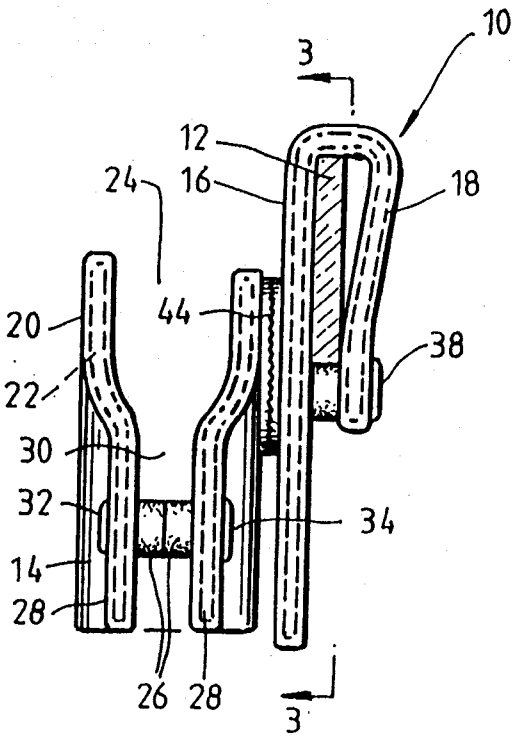
Figure 3:
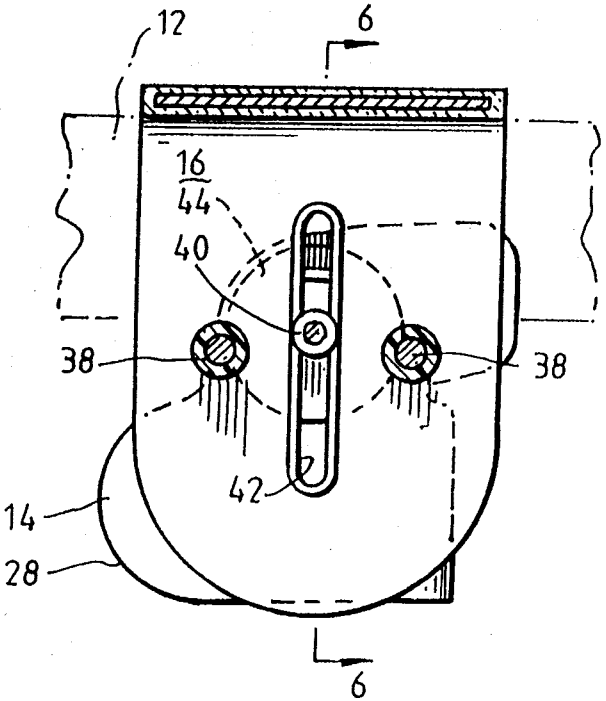
Figure 6:
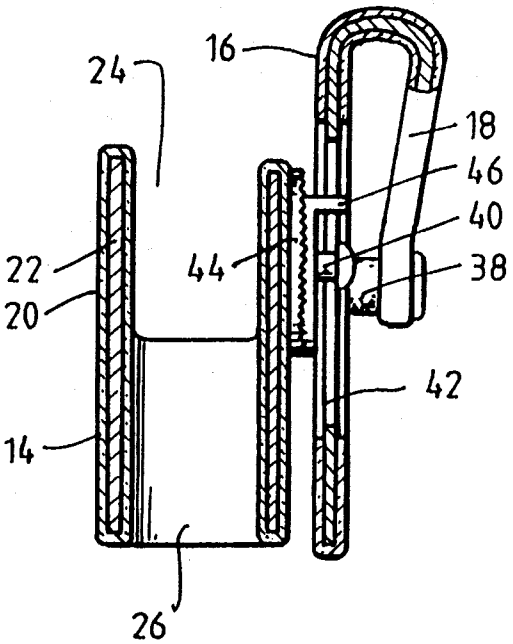
Figure 5:
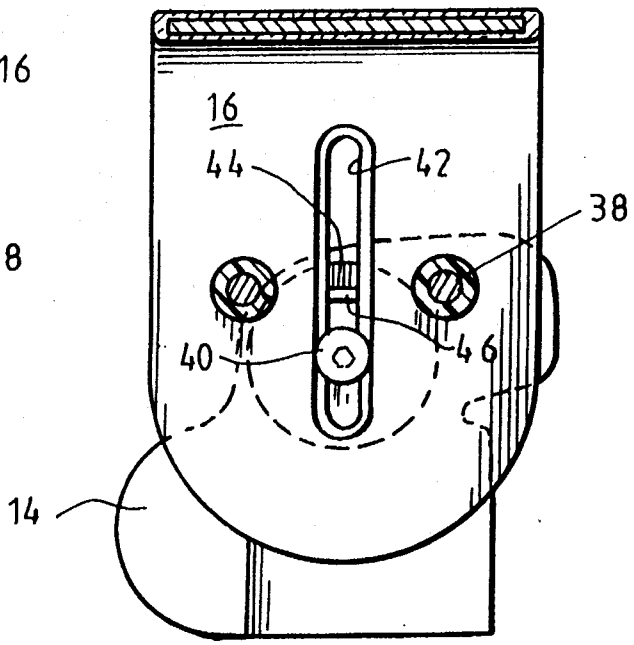
Figure 4:
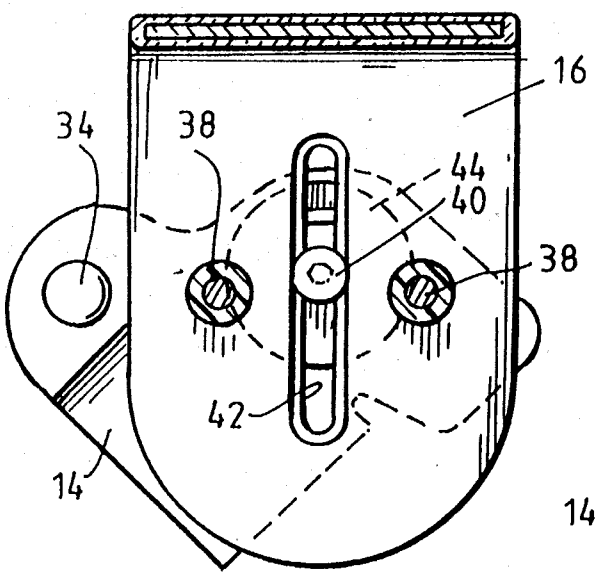

FIG. 1 is a front view of the holster;

FIG. 2 is a side view of the holster;

FIG. 3 is a vertical cross-sectional view of the holster of FIGS. 1 and 2 along the lines and in the direction of arrows 3—3 of FIG. 2;

FIG. 4 is a view corresponding to FIG. 3 but with the pouch in a second position;

FIG. 5 is a view corresponding to FIGS. 3 and 4 with the pouch in a third position; and FIG. 6 is a vertical cross-sectional view along the lines and in the direction of arrows 6—6 of FIG. 3.

DETAILED DESCRIPTION

To refer to the drawings, there is shown a holster generally designated as 10 adapted to be mounted on a belt 12. The holster 10 basically comprises a pouch 14 which is mounted on a belt-receiving member 16. The belt-receiving member 16 has a belt loop 18 through which can pass the belt 12. The belt loop 18 is secured to the main body of the belt-receiving member 16 by means of a bolt 38, in the normal manner. If desired, more than one bolt 38 may be provided.

The pouch 14 comprises a surface material 20 surrounding a reinforcing 22. It is preferable that the reinforcing 22 be a material such as, for example, aluminium, fibreglass or steel—a material which can be moulded or pressed to the required shape. The surface material 20 can be of any suitable such as, for example, a nylon, vinyl or leather.

As can be seen, the pouch 14 has a top 24 which is open and an open bottom 26 which allows the barrel of any gun to project therethrough, if required. Naturally, the pouch 14 is shaped appropriately for the gun to be contained therein.

There are two ends 28 of the pouch 14 with defined therebetween an open side 30. Extending across the open side 30 is a bolt 32 which cooperates with a captive nut 34. Mounted over the bolt 32 are spacers 26. As is clear from FIG. 2 there may be two such spacers 26. The spacers 26 press against the material of the pouch 14 adjacent the ends 28. In this way, by the tightening of the bolt 32, the spacers 26 can be pressed firmly in position and the entire pouch 14 held rigid. However, by adjusting the bolt, and even removing the bolt 32 and altering the number of spacers 26, upon the retightening of the bolt 32, the gap between the ends 28 and thus the width of the open side 30 can be varied. In this way, the user of the holster can adjust the pressure being exerted upon the gun to increase or decrease that pressure so that the ease of insertion or removal of the gun can be varied; and also the length of the barrel of the gun adjusted for, and slight variations in gun size allowed for.

The pouch 14 is mounted on the belt-receiving member by virtue of a bolt 40 which passes through the belt-receiving member 16 and engages in a nut (not shown) attached to the pouch 14. The bolt 40 passes through an elongate slot 42 in the belt-receiving member 16. Therefore, by slightly loosening the bolt 40, it can be moved along the length of the slot 42 to adjust the height of the pouch 14 relative to the belt-receiving member 16. Therefore, the height of the pouch 14 relative to the belt 12, can be adjusted. Also, and as is clear from FIGS. 4 and 5, again by loosening the bolt 40, the pouch 14 can be rotated relative to the belt-receiving member 16 with the rotation being possible over a full 360°.

If desired, a pair of serrated friction washers 44 may be provided so that upon the pouch 14 being rotated relative to the belt receiving member 16, and the bolt 40 tightened, a security of grip is maintained. Obviously with the pair of serrated friction washers 44, one half would be mounted securely to the pouch 14 and the other half slidably attached within slot 42 of the belt-receiving member 16. In this way, with the teeth of the ratchet engaging, relative movement could not take place unless the bolt 40 were sufficiently loosened. This is clear from FIGS. 3–5 with the half of the serrated friction washers 44 attached to the belt-receiving member 16 as a projection 46 which engages in the slot 42 so as to prevent relative rotation of the half of the serrated friction washers 44 attached to the belt-receiving member 16.

Whilst there has been described in the foregoing description a preferred construction of a holster for guns or the like (as hereinbefore defined) it will be understood by those skilled in the technical field concerned that many variations or modifications in details of design or construction may be made without departing from the present invention.

We claim:

1. A holster for a gun comprising a pouch for receiving said gun, said pouch being mounted on a belt-receiving member; said belt-receiving member having an elongate vertical slot therein, said pouch being mounted to said belt-receiving member by means of a fastening means passing through said elongate vertical slot, said fastening means being able to be selectively released to allow said pouch to be moved vertically relative to said belt-receiving member by moving said fastening means along said slot, and said pouch being able to be releasably rotated about said fastening means by a pair of serrated friction washers mounted around said fastening means and between said pouch and said belt-receiving member, one of said washers secured to said pouch, and the other of said washers slidably secured to said slot.

2. A holster as claimed in claim 1, wherein said fastening means is a bolt cooperating with a nut attached to said pouch.

3. A holster as claimed in claim 1, wherein said other of said serrated friction washer has a projection engaging in said slot to prevent relative rotation between said belt-receiving member and said other of said serrated friction washer.

4. A holster as claimed in claim 1, wherein said pouch has an open top and an open bottom.

5. A holster as claimed in claim 4, wherein said pouch has two substantially parallel but spaced apart ends defining an open side therebetween, there being provided a bolt passing through one of said ends, across said open side, and co-operating with a captive nut in the other of said ends, said bolt having at least one spacer therearound to maintain said ends apart.

* * * * *